US006286561B1

(12) United States Patent
Armbrust et al.

(10) Patent No.: US 6,286,561 B1
(45) Date of Patent: Sep. 11, 2001

(54) METHOD AND APPARATUS FOR MONITORING THE REMOVAL OF A CATCH SELVAGE FROM A LOOM

(75) Inventors: Matthias Armbrust, Wangen; Michael Birk, Hergensweiler, both of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/712,831

(22) Filed: Nov. 13, 2000

(30) Foreign Application Priority Data

Nov. 11, 1999 (DE) ..... 199 54 139

(51) Int. Cl.[7] ..... D03D 47/40; B65H 39/04
(52) U.S. Cl. ..... 139/302
(58) Field of Search ..... 139/302

(56) References Cited

U.S. PATENT DOCUMENTS 4,171,008 * 10/1979 Onishi et al. ..... 139/302
5,560,400 * 10/1996 Meyns et al. ..... 139/302
5,735,316 * 4/1998 Hehle ..... 139/194
6,102,082 * 8/2000 Hehle et al. ..... 139/302

FOREIGN PATENT DOCUMENTS 2820251 12/1978 (DE) .
197 13 089 * 1/1998 (DE) .
0681044 11/1995 (EP) .
2000-314050 * 11/2000 (JP) .

* cited by examiner

*Primary Examiner*—Andy Falik
(74) *Attorney, Agent, or Firm*—W. F. Fasse; W. G. Fasse

(57) ABSTRACT

The removal or transport of cut-off catch selvages in a loom is monitored by one or more sensors which produce a sensor output signal that represents the actual movement of the cut-off catch selvage. The sensor output signal is processed in an evaluation processor for producing a fault signal if and when the sensor output signal deviates from a predetermined standard or reference signal. The fault signal is used to trigger an alarm and/or stop the loom.

21 Claims, 7 Drawing Sheets

METHOD AND APPARATUS FOR MONITORING THE REMOVAL OF A CATCH SELVAGE FROM A LOOM

PRIORITY CLAIM

This application is based on and claims the priority under 35 U.S.C. §119 of German Patent Application 199 54 139.6, filed on Nov. 11, 1999, the entire disclosure of which is incorporated herein by reference.

FIELD OF THE INVENTION

The invention relates to the removal of catch selvages from a fabric being woven in a weaving loom. A catch selvage is formed to temporarily bind weft ends until the wefts are beat up. Thereafter, the catch selvage is cut off and removed. The invention teaches the monitoring and controlling of the catch selvage removal.

BACKGROUND INFORMATION

It is conventional to secure or fix weft thread ends by the formation of a so-called catch selvage along the weft entrance side of the fabric and along the weft exit side of the fabric. Each selvage is formed by at least two catch selvage threads acting as warp threads, so to speak, and the weft ends projecting from the loom shed. As soon as the catch selvage has served its purpose it is cut-off a short distance from the beat-up line of the fabric. A pull-off or withdrawal mechanism for the cut-off catch selvage cooperates with detour elements for withdrawing the cut-off catch selvage and transporting it into a collecting container. If the material flow of the cut-off catch selvage or selvages is not monitored and properly controlled, the weaving process may be disturbed by ripping of the catch selvages, by winding the catch selvages onto the catch selvage withdrawal apparatus or even by winding the cut-off catch selvages or one of these selvages onto the cloth take-up beam.

German Patent Publication DE 28 20 251 (Onishi et al.) discloses an apparatus for ascertaining a failure in the withdrawal of catch selvage yarns. It is not clear from the Onishi disclosure whether the monitoring takes place after the catch selvage yarns have been formed into a catch selvage or prior to such formation. In any event, a catch selvage yarn withdrawal mechanism (10, 12) including at least one driven roller cooperating with a further roller pulls the catch selvage yarn off and out of the loom. The catch selvage yarn or yarns is pinched between the two transport rollers which rotate in opposite directions so as to apply the necessary withdrawing force to the catch selvage yarns. At least one of the two rollers is spring-biased relative to the other roller to provide the necessary friction for the withdrawal. Further, at least one of the rollers is movable away from the other in response to any accumulation of selvage catch yarns between the two rollers in order to generate a fault or alarm signal when an excess of catch selvage yarns has been accumulated between the two rollers. The fault or alarm signal is produced when the normal spacing between the two rollers is exceeded by a predetermined value. Such a mechanism is not capable of accommodating different types and sizes of weft threads and catch selvage yarn qualities on the same loom, for example thick yarns in one weaving operation and relatively thin yarns in another weaving operation which are required to be handled by the same loom for different types of fabrics.

If after a certain yarn has been used in one weaving operation and thereafter different yarns are to be used, the known apparatus, according to Onishi et al. requires a fine readjustment of the withdrawal rollers, in order to assure a proper functioning of the known monitoring apparatus for indicating a fault in the withdrawal flow of catch selvage yarns. Another drawback of the known apparatus is seen in that its response characteristic is rather slow, especially when relatively thin catch selvage yarns and relatively thin weft threads are used because a certain accumulation of yarns between the transport rollers is required before the two rollers are sufficiently separated from each other to release a fault or alarm signal. Thus, the generation of a fault signal may not occur until substantial damage has already resulted.

European Patent Publication EP 0,681,044 A1 (Meyns et al.) discloses a method and apparatus for withdrawing cut-off catch selvages. A monitoring of the flow of the cut-off catch selvage is not disclosed. However, the withdrawal rollers are provided with a friction increasing surface to assure a proper withdrawal. Further, at least one of the withdrawal rollers is so positioned relative to the other withdrawal roller that a loop of more than 150° is formed by the cut-off catch selvage around one of the rollers. However, such loop formation does not involve any monitoring to assure a proper withdrawal operation.

OBJECTS OF THE INVENTION

In view of the above it is the aim of the invention to achieve the following objects singly or in combination:

- to monitor and control the withdrawal of cut-off catch selvage or selvages in such a way that any faults in the withdrawal are immediately recognized for generating a respective fault signal independently of the quality or characteristics of the weft thread and of the yarns used for forming the catch selvages;
- to immediately generate and process the fault signal for producing a respective alarm and/or a control signal without delay for either stopping the loom or correcting the withdrawal; and
- to use various types of sensors such as inductive, capacitive, optic, or piezoelectric sensors including sensors that respond to a change in the torque moment in any one of the electric motors that drive the cut-off selvage withdrawal rollers.

SUMMARY OF THE INVENTION

The method of the invention assures advantageously a proper withdrawal of the cut-off catch selvages by monitoring the withdrawal direction and/or the withdrawal velocity. If faults occur when the catch selvages are withdrawn during the weaving operation, these faults are measured or sensed with certainty and rapidly so that any adverse influences on the productivity of the weaving loom are either eliminated or at least minimized.

According to the invention a monitoring device is arranged downstream, relative to the movement direction of the cut-off catch selvage from the cut-off point to the collection point, of any detouring elements that guide the cut-off catch selvages to the monitoring device which signals the presence of the cut-off catch selvages in their proper withdrawal path by means of electrical signals which are supplied to an electronic processing unit which in turn provides a respective signal to the main loom control or to a separate control for the catch selvage withdrawal. Preferably such separate control forms part of the main loom control.

According to a first embodiment of the invention the monitoring device comprises a guide mechanism either stationary or in the form of rollers for the cut-off catch selvages. In the case where guide rollers are employed, these guide rollers rotate in response to the powered withdrawal of the cut-off catch selvages by means of a catch selvage withdrawal apparatus including respective drive motors. Either the rotation direction forward or backward and/or the rotation speed of the guide rollers is monitored or sensed by a respective sensor arrangement, whereby the resulting electrical signals are processed and evaluated in the electronic processing unit that is preferably part of the main loom control. At least one sensor mechanism is provided for each guide roller. In a preferred embodiment the sensor mechanism includes at least one marking on the respective guide roller and at least one sensor positioned in a fixed location opposite of the marking for sensing the marking as the marking on the rotating roller passes the respective sensor thereby producing a corresponding electrical signal or impulse.

The marking on the guide rollers must be so-constructed that the corresponding sensor can respond with certainty to the appearance of the marking. Thus, preferably inductive, capacitive or optical sensors are used in the embodiments in which markings are provided on the rotating guide rollers. Such sensors may, for example be inductively responsive sensors for example a Hall sensor, optical reflector sensors, or capacitive sensors. An inductive sensor may cooperate with a permanent magnet secured to the guide roller as a marking. A reflective optical marking may be secured to the guide roller for cooperation with an optical sensor including infrared sensors. A capacitively effective marking may be secured to the guide roller for cooperation with a stationary capacitive sensor. In all instances the monitoring signal is produced under normal operating conditions when the marking on the rotating guide roller passes the stationary sensor. Thus, a typical, normal pulse train or pulse sequence is produced when the guide rollers are rotating with their markers past the sensors whereby the typical impulse sequence in a pulse train depends on the rotational speed of the guide roller and thus on the r.p.m. of the loom. When the typical, normal pulse train changes a fault is discovered as will be described in more detail below. Preferably, several sequentially arranged markers are provided for each guide roller for producing periodically recurring impulses as the guide roller rotates. Such periodical, impulse sequence may be achieved, for example, in that several markings are secured to the guide rollers at different rotational angles, whereby these markings cooperate with at least one stationary sensor so positioned that the markings must pass the sensor to sequentially communicate with the sensor. In an alternative embodiment, several sensors may be arranged in fixed locations at determined angular spacings to sequentially cooperate with a respective marking on each guide roller.

Another embodiment of the present apparatus for monitoring the proper withdrawal of cut-off catch selvages, uses a piezoelectric sensor or sensors. In this embodiment the basic construction of the monitoring device is similar to the construction described above with the exception that the guide members equipped with piezoelectric signal generators must be kept stationary while the catch selvage travels on these stationary guide members. A piezoelectric sensor element is installed in that part of the guide member that is in contact with the catch selvage as the catch selvage is being withdrawn.

In the embodiment in which the withdrawal of the catch selvage is monitored by torque moment responsive elements such as motor r.p.m. sensors the fault signal is produced when the r.p.m. changes. In this embodiment the withdrawal apparatus is driven by a torque moment controlled electrical drive motor.

In all embodiments, the signals produced by the sensors are transmitted to the processing and evaluating unit through a signal conductor bus such as a CAN bus.

In the embodiments where the catch selvage guide rollers rotate, the electronic signal processing and evaluating unit ascertains automatically the time intervals between impulses following one another in the sequence as a function of the r.p.m. of the loom. The resulting defined repetition of these impulses or impulse trains is monitored and when the repetition shows an unnormal rotation, a fault signal is generated and/or the loom is stopped.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
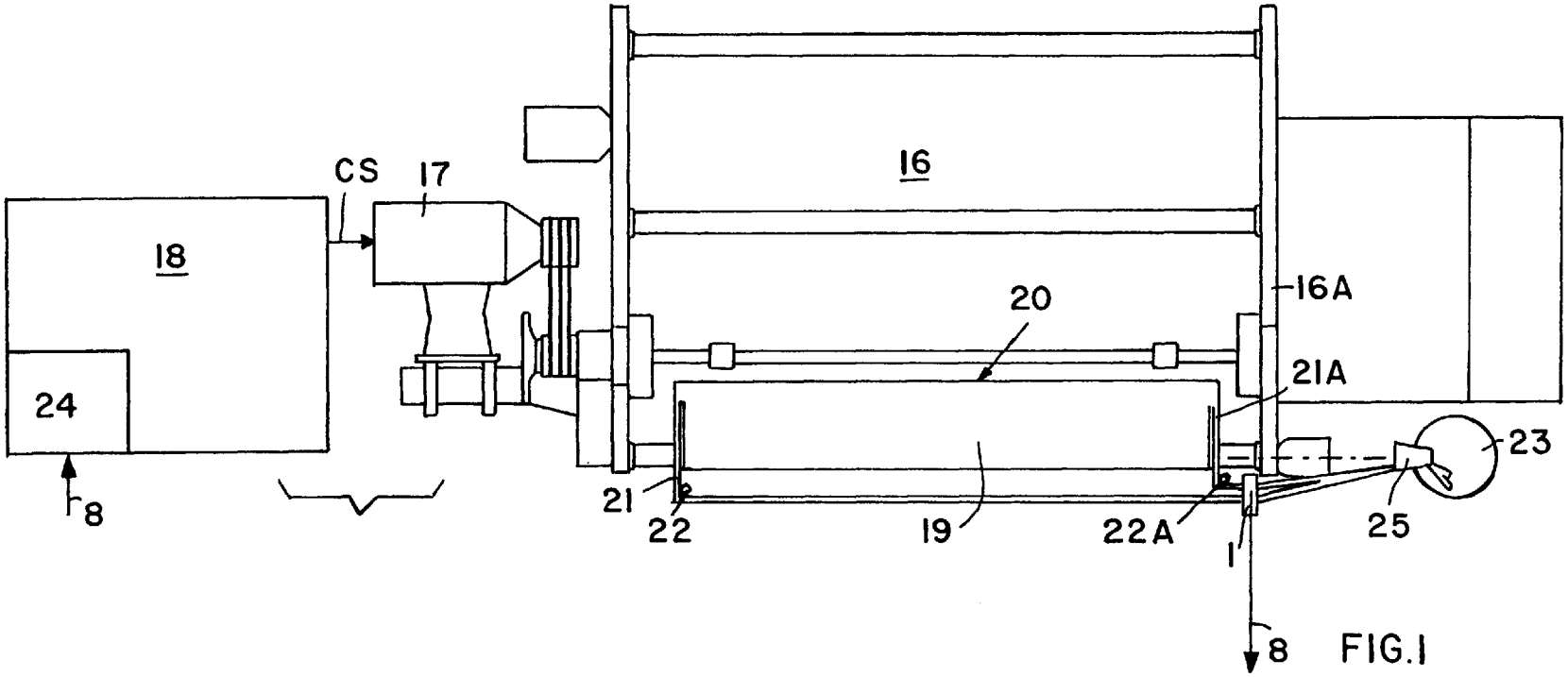
FIG. 1 is a schematic illustration of a weaving loom equipped with a catch selvage pull-off mechanism and with one monitoring device according to the invention for monitoring both cut-off selvages as they are moved into a collection container.

FIG. 1 shows a schematic view of a weaving loom 16 with a main loom drive 17. Details of the loom, of the weaving operation and of the catch selvage cut-off mechanism are not shown since these are not essential for a full disclosure of the invention. The loom 16 is controlled by a main loom control 18. A woven fabric web 19 is drawn off downwardly out of the weaving plane from a beat-up line 20 where the weft is beat-up against the fabric.

The ends of the weft threads at the insertion side of the loom shed and at the exit side of the loom shed are temporarily tied up in a respective catch selvage 21, 21A along the edges of the fabric web 19. The catch selvages 21, 21A are conventionally cut off from the edges of the fabric 19 a short distance from the beat up line 20. The cut-off catch selvages 21, 21A are pulled off or withdrawn by passing the selvages over detour guides 22, 22A by a withdrawal drive unit 25 which discharges the pulled off catch selvages into a collecting container 23. According to one embodiment of the invention a monitoring unit 1 for both selvages 21, 21A is positioned between the detour guides 22, 22A on the one hand and the withdrawing unit 25. Relative to the movement direction of the catch selvages 21, 21A the detour guides 22, 22A are positioned upstream of the monitoring unit.

The monitoring unit 1 according to the invention comprises two guide rollers 2 and 2A one for each of the cut-off catch selvages which pass to the withdrawal drive unit 25, whereby a fault-free removal of the cut-off catch selvages 21, 21A is assured under normal operating conditions. The guide rollers 2 and 2A are preferably free wheeling rollers that rotate in response to the friction force applied by the tension of catch selvages 21, 21A to the rollers 2, 2A. In order to assure the driving of the guide rollers 2, 2A it is preferred that the respective guide roller grooves 2', 2A' have a contact increasing structure such as a friction increasing coating or texture.

Figure 2:
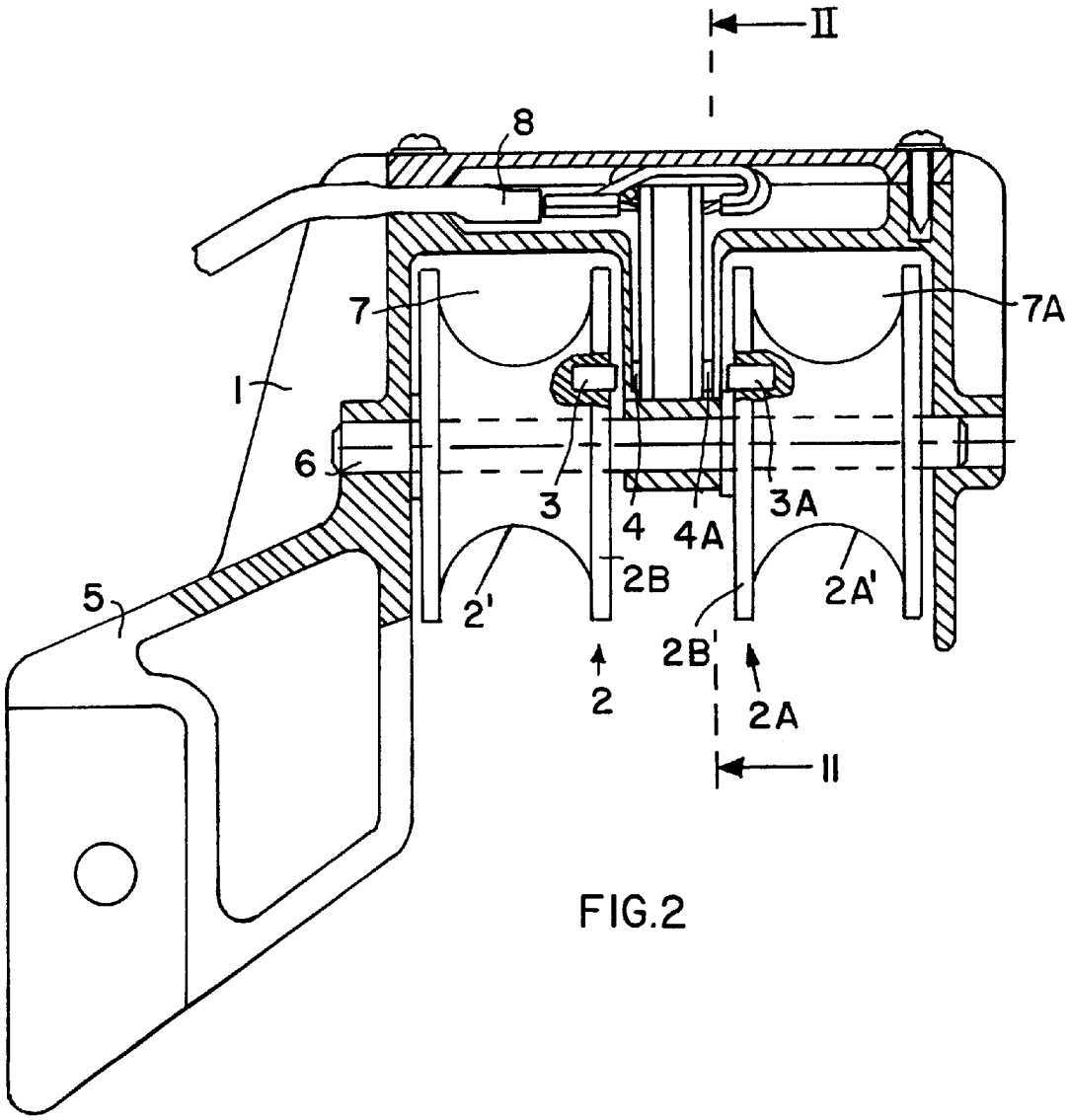
FIG. 2 is a sectional view through a monitoring device according to the invention with two rotatably supported cut-off selvage guide rollers provided with inductive sensors for generating respective monitoring signals.

According to a first embodiment of the invention shown in FIG. 2, the monitoring unit 1 comprises a housing 5 secured to a loom frame 16A. The guide rollers 2 and 2A which are part of the present sensor mechanism, are mounted for rotation on an axle 6 mounted in the housing 5 to extend across two recesses 7 and 7A in which the guide rollers 2 and 2A are rotatably received. The catch selvages 21, 21A pass through grooves 2' and 2A' of the respective rollers 2 and 2A and through the recesses 7 and 7A, whereby the withdrawal force applied by the pull-off unit 25 to the catch selvages 21, 21A causes the rollers 2 and 2A to rotate.

The rollers 2 and 2A are provided with respective flanges 2B, 2B'. According to the invention each flange 2B, 2B' is equipped with at least one small permanent magnet 3, 3A housed in respective recesses in the flanges, whereby these permanent magnets 3, 3A rotate with the rollers 2, 2A. These magnets 3, 3A form at least one marking on each guide roller 2, 2A for cooperating with a respective sensor 4, 4A preferably in the form of Hall sensors. Preferably one Hall sensor is provided for each roller. These Hall sensors 4, 4A are mounted in a stationary position in the housing 5 opposite the magnets 3, 3A as shown in FIG. 2. As the rollers 2, 2A rotate, so do the magnets 3, 3A around the axis 6, thereby passing, depending on the rotational speed of the rollers, at predetermined timed intervals, the sensors 4, 4A to thereby generate respective electrical impulses. If only one marking is provided on each roller for cooperation with one stationary sensor, one impulse will be produced for each revolution of each roller. However, it is preferred that more than one impulse will be generated for each revolution as will be described in more detail below with reference to FIG. 6. One or more impulses per revolution are transmitted through a conductor bus 8 such as a CAN bus from the respective sensors to a processing and evaluation unit 24 which preferably is part of the central loom control 18 as shown in FIG. 1 or the unit 24 may be separate from the main loom control.

Figure 2A:
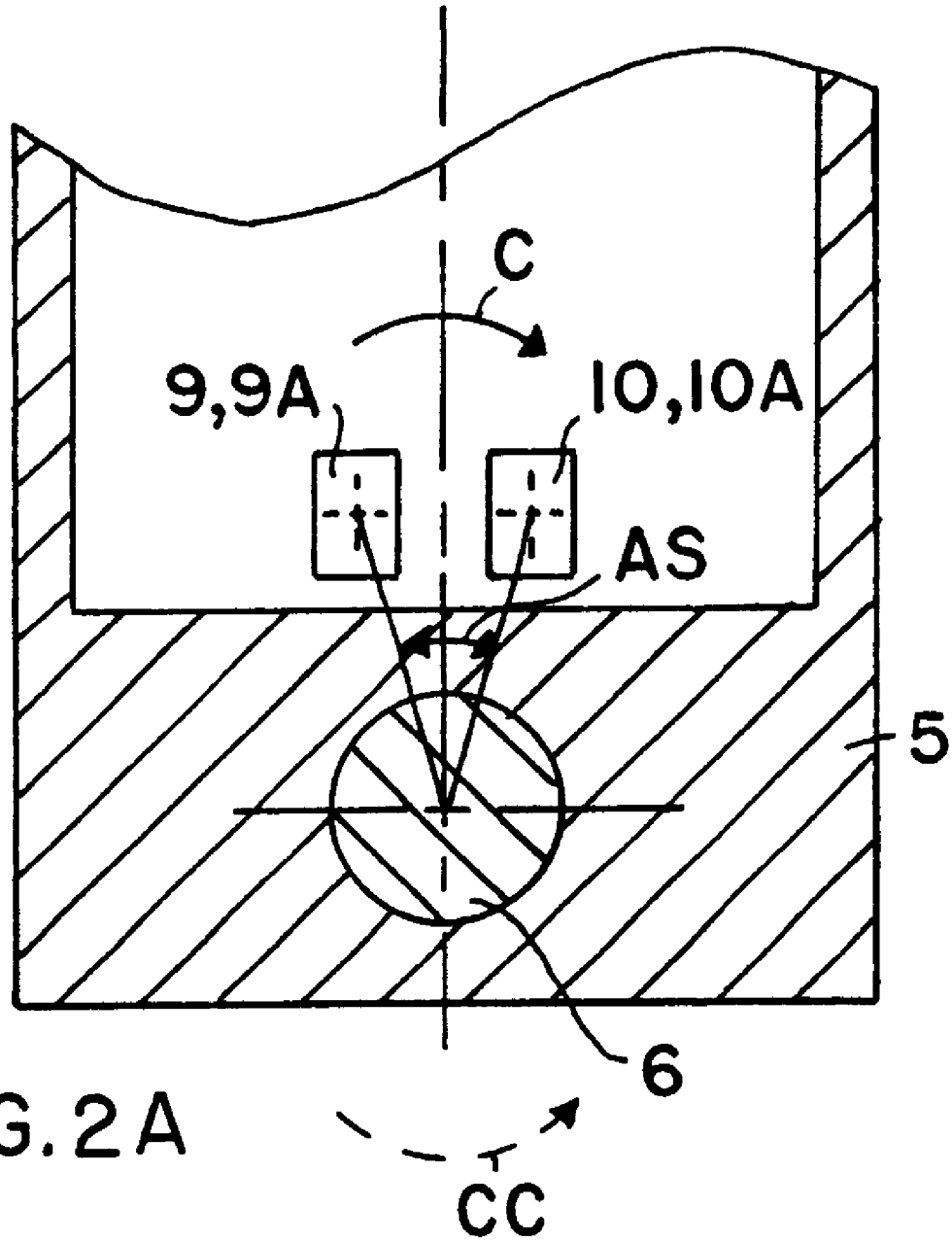
FIG. 2A is a sectional view along section line II—II in FIG. 2 to show angularly spaced, stationary sensors.

As mentioned above, in a preferred embodiment each guide roller 2, 2A comprises a plurality of markers such as optical reflectors or magnets 3, 3A circumferentially spaced on-center at defined angular spacings AS seen in FIG. 2A, whereby the markers such as magnets are positioned on a circle relative to the center of the axis 6 at the different rotational angles as mentioned. The stationary sensors 4, 4A are positioned on a corresponding circle fixed in the housing 5, whereby the magnets or sensors 4, 4A have the same angular on-center spacings AS from one another as the markers. However, these angular spacings AS may differ between neighboring markers and neighboring sensors. For example, one angular spacing may be 45° while the next spacing may be 90°, see FIG. 6. Generally, these angular spacings will be within the range of 1 to 90°.

Figure 6:
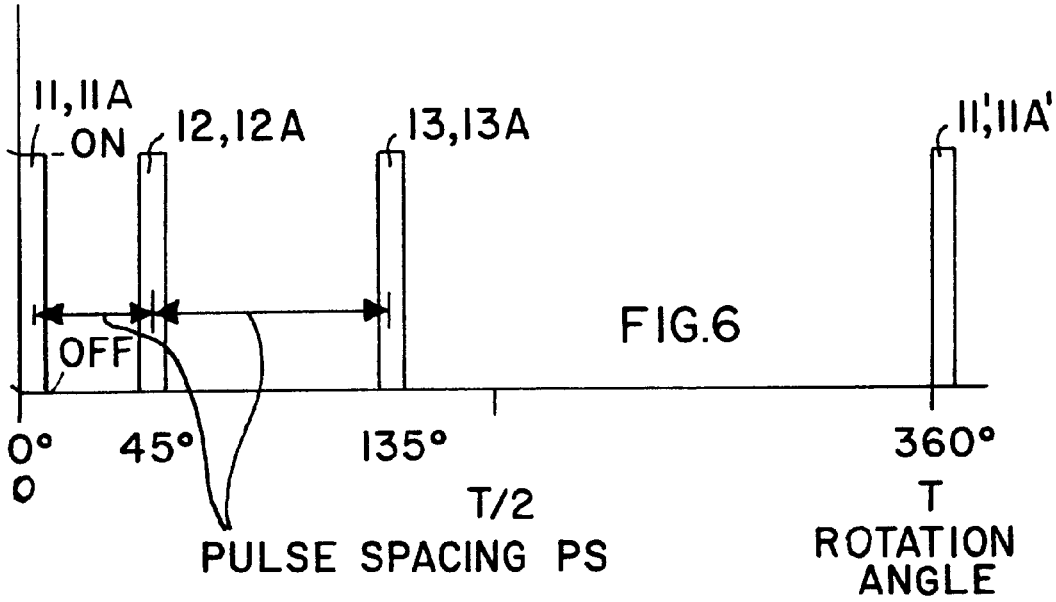
FIG. 6 illustrates an impulse train as a function of time and as a function of the rotation of the respective guide roller for explaining the operation the monitor according to FIGS. 2 or 3.

The just described arrangement of markers and sensors in the rollers and Hall sensors in the stationary housing, provides for example, depending on the density of weft threads and depending on the loom r.p.m., three impulses 11, 12 and 13 and 11A, 12A, 13A respectively for each revolution of each roller 2, 2A, if there are three markers and at least one sensor for each roller or at least one marker and three sensors for each roller. These impulses are spaced from one another by precise time intervals or pulse spacings PS as shown in FIG. 6 if the withdrawal of the cut-off catch selvages proceeds under normal operating conditions. The pulse spacing PS between the individual impulses of a pulse train are, for example 45° between the impulse 11 and 12 and 90° between the impulse 12 and 13. The same applies to the impulses 11A, 12A and 13A. When one revolution of the guide rollers 2, 2A is completed, a new sequence of impulses 11A, 11A' and so forth is generated for each revolution of the guide rollers 2 and 2A.

Referring to FIG. 6, when the weaving loom 16 is started and reaches its nominal r.p.m., the respective impulses or pulse trains are transmitted through the bus 8 to the electronic processing and evaluation unit 24 which is, for example, constructed as a self-learning microcomputer control. The unit 24 first ascertains the timely sequence or time intervals of the sensor impulse signals 11, 12, 13 and respectively 11A, 12A, 13A. The respective information is stored and thereafter the following impulse sequences are monitored with respect to the first stored sequence as the weaving proceeds. If one or several signals 11, 12, 13 or 11A, 12A, 13A do not occur at all or do not occur in the initially determined sequence at the nominal r.p.m., and within a preselectable time frame such as one revolution, such missing pulses or deviating time intervals signify a fault in the catch selvage removal.

If one of the catch selvages 21, 21A should, for whatever reason, be pulled back rather than forward for disposal, the respective pull back causes a rotation of the respective guide roller 2 or 2A in the opposite direction which can be immediately recognized by an opposite pulse sequence, namely 13, 12, 11 or 13A, 12A, 11A. For this purpose at least two magnets, for example 3 or 3A must pass the respective sensor 4 or 4A in the opposite rotational direction. Any irregular pulse sequence resulting from such a fault is processed in the unit 24 for generating a fault signal to produce an alarm and/or to stop the loom.

Figure 7:
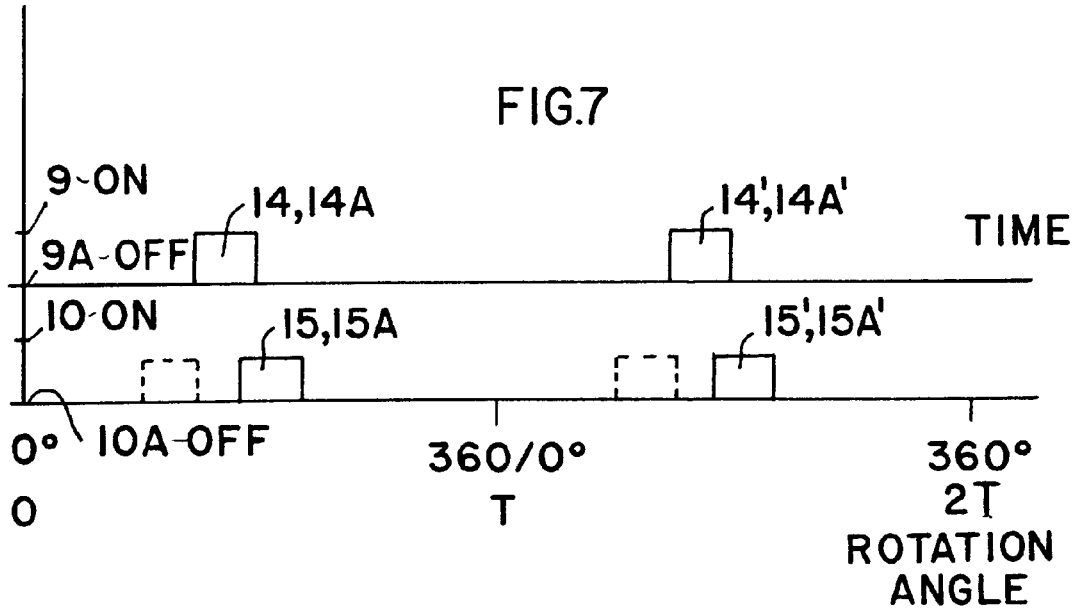
FIG. 7 shows pulse trains as a function of time and thus of the rotational angle of the guide rollers of FIG. 2A for explaining the operation of angularly displaced sensors.

FIG. 2A illustrates an embodiment where two sensors 9, 9A or 10, 10A are stationarily positioned in the housing 5 for cooperation with the respective guide roller 2 or 2A which is not shown in FIG. 2A. Each guide roller, however, is preferably provided with but one marker such as a magnet 3 or 3A. These markers pass both sensors in sequence. When the rollers rotate in the clockwise direction C, the markers first pass the respective sensors 9, 9A and then 10, 10A to signify a proper catch selvage withdrawal. This proper catch selvage withdrawal is illustrated in FIG. 7 by the full line impulses 14*m* 14A; 14', 14A'. The magnet 3 will first pass the sensor 9 and then the sensor 10 while the magnet 3A will first pass the sensor 9A and then the sensor 10A. With this sequence the cooperation of the magnet 3 with the sensor 9 produces the impulse 14. The cooperation of the magnet 3A with the sensor 9A produces the impulse 14A. Similarly, the cooperation of the magnet 3A with the sensor 9A and then with the sensor 10A produces the signals 15, 15A slightly delayed relative to the impulses 14, 14A. As shown in FIG. 7 there may be an overlap in time between the impulses 14, 15 or 14A, 15A. In the next revolution the same impulses are produced as shown at 14', 14A' and 15', 15A' in FIG. 7. These impulses are supplied through the conductor bus 8 to the evaluating and processing unit 24. As long as the correct sequence as just described is maintained, no fault signal is generated. However, if the signal or pulse sequence is changed, while the loom r.p.m. remains the same, for example when the signals 15, 15A or 15', 15A' occur prior to the impulses 14, 14A or 14', 14A' as shown by dotted impulses in FIG. 7, then this is an indication that the respective guide roller has changed its direction which signifies a fault when one or the other or both selvages 21, 21A are pulled back to rotate the respective rollers in the opposite direction. In that case, the evaluating unit 24 generates a fault signal that may cause an alarm and/or stop the loom.

Figure 3:
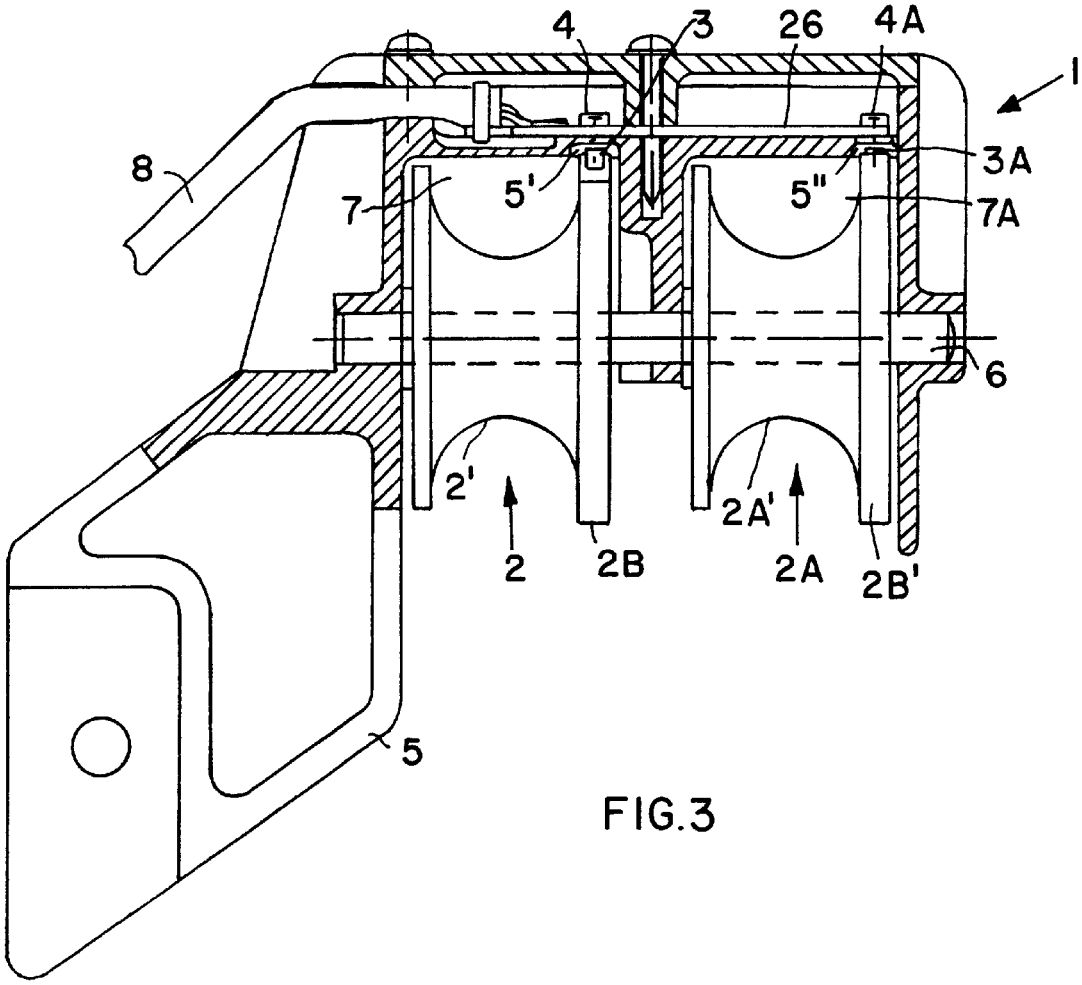
FIG. 3 is a sectional view similar to that of FIG. 2, however with a different position of the sensor elements such as inductive sensor elements.

FIG. 3 shows a modified embodiment, compared to that of FIG. 2, of the monitoring unit 1. The guide rollers 2, 2A again rotate on the axis 6 within the respective U-cross-sectional recess 7, 7A of the housing 5. At least one magnet 3, 3A is installed into one sidewall or flange 2B, 2B' of the respective guide roller 2, 2A in the circumference of the flange 2B, 2B' of the respective guide roller. Sensors 4, 4A are mounted in a stationary position on a plate 26 which in turn is stationarily mounted in the housing 5. The embodiment of FIG. 3 functions in the same way as that of FIG. 2, however with the advantage that maintenance work is facilitated.

An erroneous installation of the rollers 2, 2A is avoided by making the flanges 2B, 2B' somewhat larger in diameter and somewhat thicker in the axial direction. The marker formed by the magnets 3, 3A is mounted in the circumferential surface of the larger diameter and thicker flange and the housing is provided with a respective groove 5', 5"0 so that the larger diameter flange 2B, 2B' is accommodated. This arrangement assures a correct installation of the guide rollers in the housing 5. An erroneous installation is prevented and if inadvertently the guide rollers are turned by 180° the rollers would not fit into their recesses 7, 7A. Further, if the rollers would fit, there would be no cooperation between the magnets 3, 3A and the respective sensors 4, 4A.

Figure 4:
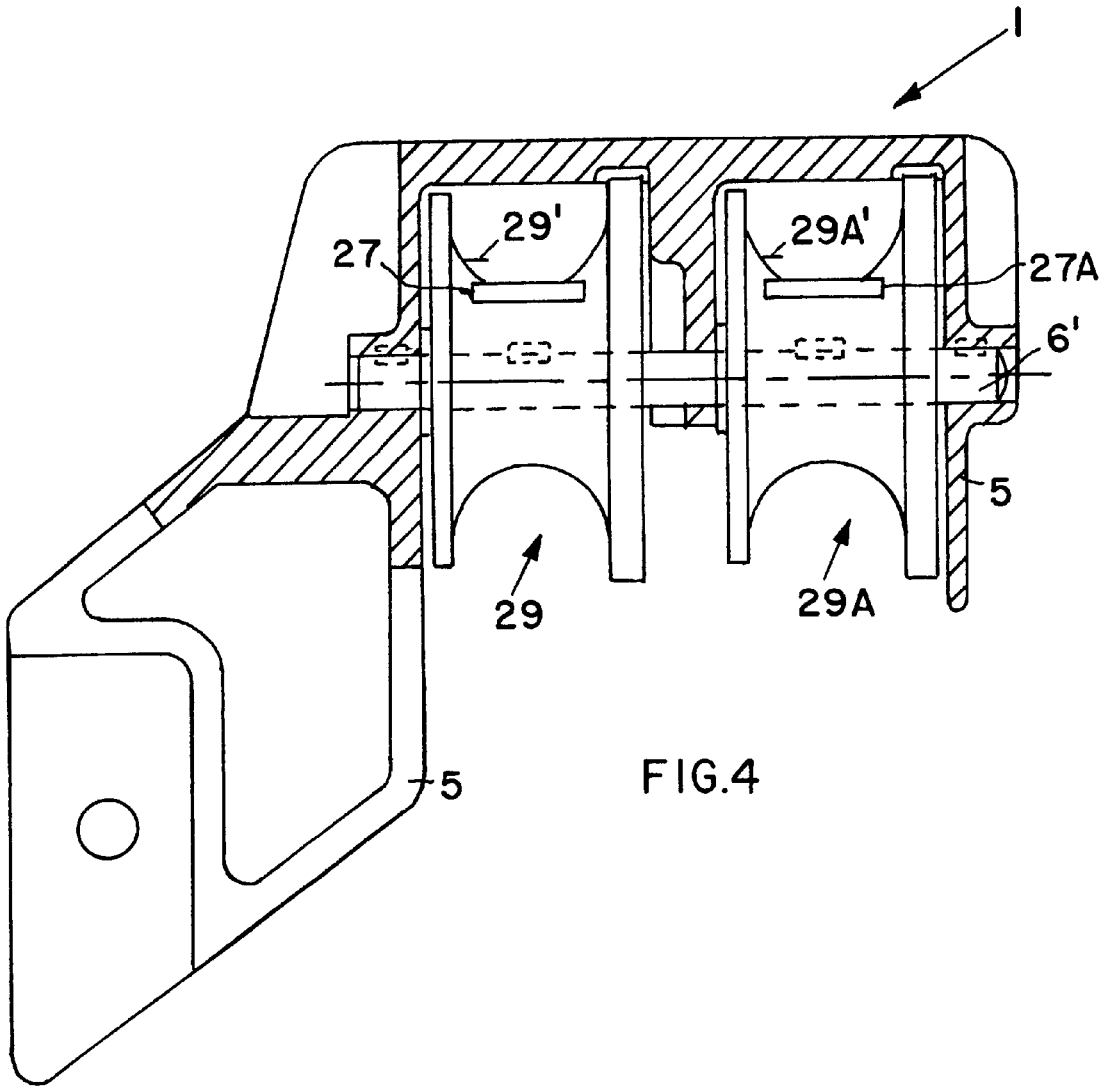
FIG. 4 is a sectional view through stationary guide elements with piezoelectric sensors for generating monitoring signals.

FIG. 4 shows an embodiment in which the guide rollers 2, 2A have been replaced by stationary guide members 29, 29A also mounted in a housing 5 on a rigidly mounted support member 6'. Rotation is prevented by conventional lock tongues or by respective press fits, for example. Each stationary guide member 29, 29A is provided with a respective guide groove 29', 29A' through which the catch selvages 21, 21A are pulled by the withdrawal unit 25. A piezoelectric sensor 27, 27A is mounted in each groove 29' and 29A' respectively. Electrical signals are produced as the catch selvage 21, 21A is pulled over the piezoelectric sensors 27, 27A. The resulting signals are again transmitted through the conductor bus 8 to the processing and evaluation unit 24. The bus is shown, for example in FIGS. 2 and 3. If the tension on the catch selvage stops, a fault is present and the respective signal generated by the piezoelectric sensors 27, 27A also ceases which triggers a fault signal.

Figure 5:
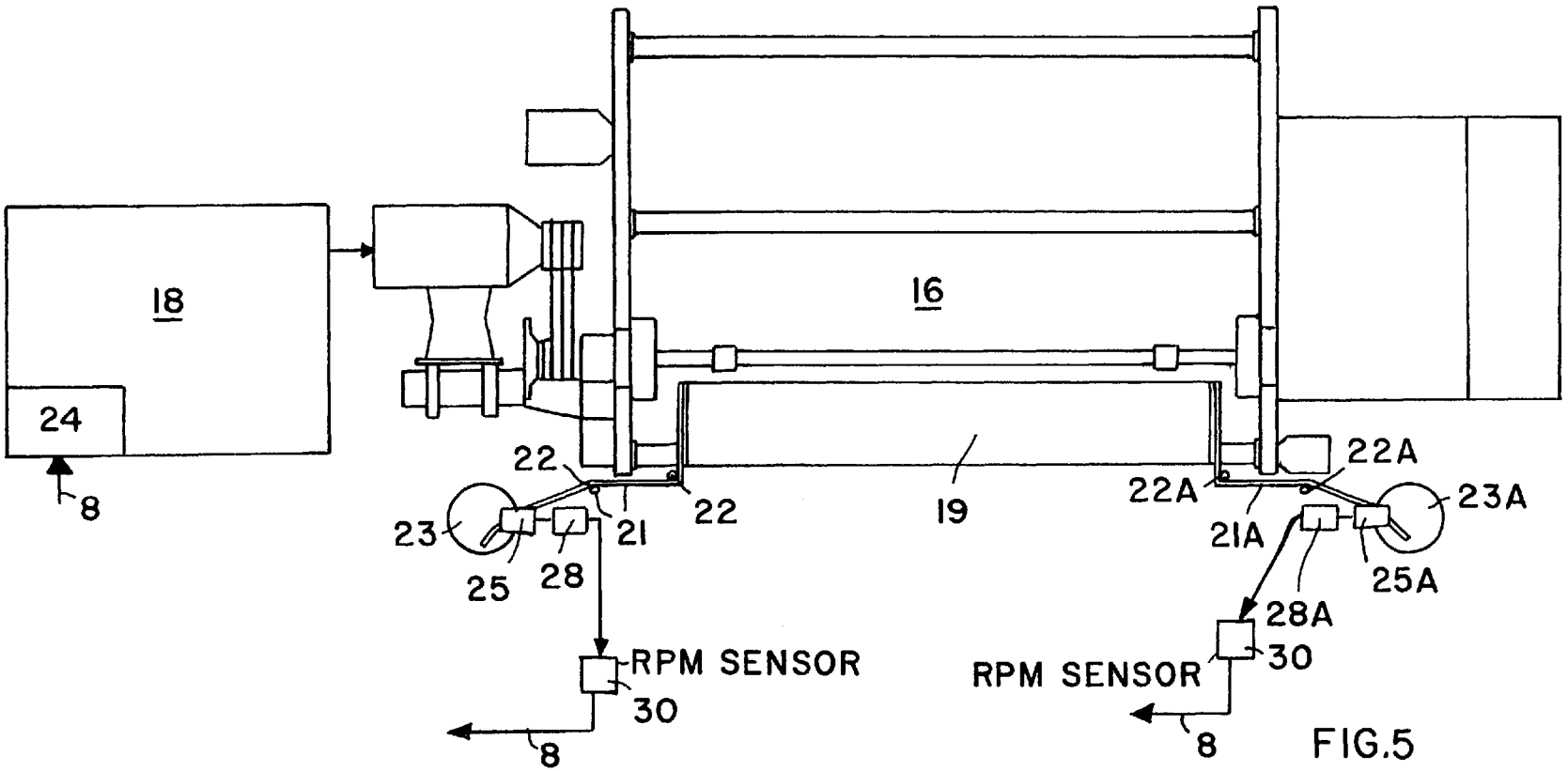
FIG. 5 is a view of a loom similar to that of FIG. 1, however, showing how a monitoring signal is derived from the torque moment of one or two catch selvage pull off drive motors.

FIG. 5 illustrates an embodiment of the invention in which the monitor of the withdrawal of the two catch selvages 21, 21A comprises an r.p.m. sensor 30 that senses the r.p.m. of electric drive motors 28, 28A for respective cath selvage take-up units 25A. The electric drive motors 28, 28A are torque moment controlled in closed loop fashion. Under normal operating conditions the motors 25, 25A run at their rated r.p.m. while properly pulling off the respective catch selvage 21, 21A. However, when such pulling ceases, for example because the selvage ripped, the motor r.p.m. will increase. The increased r.p.m. is measured by the r.p.m. sensor 30 which supplies a respective signal through the conductor bus 8 to the processing unit 24 which produces a respective fault signal.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for monitoring a catch selvage removal in a weaving loom, wherein said catch selvage after its formation for tying weft ends, is cut-off and a cut-off catch selvage is removed, said method comprising the following steps:

(a) transporting said cut-off catch selvage over at least one detour member into a container, (b) sensing said transporting of said catch selvage for producing a sensor output signal that represents a catch selvage transporting characteristic;

(c) supplying said sensor output signal to a signal processing and evaluation unit;

(d) monitoring said sensor output signal for an occurrence of any changes in said sensor output signal, and (e) generating a fault signal in response to a change in said sensor output signal.

2. The method of claim 1, further comprising performing said sensing step by a sensor selected from any one of inductive, capacitive, optical, piezoelectric and torque responsive sensors.

3. The method of claim 2, wherein said sensing step is performed as a function of an r.p.m. of said weaving loom to produce said sensor output signal.

4. The method of claim 1, wherein said sensing step is performed by the following substeps:

(a) moving said cut-off catch selvage in sliding contact with a piezoelectric sensor, and (b) producing said sensor output signal by said piezoelectric sensor in response to a catch selvage removal pull-off speed representing said transporting characteristic.

5. The method of claim 1, wherein said sensing and producing step is performed by a torque responsive sensor (30) for producing said sensor output signal in response to a torque moment applied for said transporting said cut-off catch selvage.

6. The method of claim 5, wherein said torque responsive sensor measures a torque dependent r.p.m. of an electric drive motor for said transporting said cut-off catch selvage.

7. The method of claim 1, further comprising interconnecting a sensor for performing said sensing step with said evaluation unit through a signal bus system, such as a CAN-bus system.

8. The method of claim 1, further comprising stopping said weaving loom in response to said fault signal.

9. The method of claim 1, further comprising producing said sensor output as at least two impulses following each other in an actual time sequence, monitoring said time sequence with reference to a rated impulse time sequence that signifies a catch selvage transport free of faults, and generating said fault signal in response to a deviation of said actual time sequence from said rated time sequence.

10. The method of claim 1, further comprising producing said sensor output signal as a first and a second impulse following each other in an actual time sequence, monitoring said actual time sequence to ascertain which impulse of said first and second impulses occurs first, and generating said fault signal in response to said second impulse occurring prior to said first impulse.

11. The method of claim 10, wherein said first and second impulses partly overlap each other in time.

12. An apparatus for monitoring a catch selvage removal from a weaving loom, wherein said catch selvage is cut-off for removal, said apparatus comprising at least one catch selvage detouring member (22, 22A), a drive mechanism (25, 25A) for transporting said cut-off catch selvage over said at least one detouring member into a container, sensor means (3, 4; 27, 30) positioned for sensing said transporting of said catch selvage to provide a sensor output signal, and a signal processing unit (24) ID operatively connected to receive said sensor output signal for processing and for producing a fault signal in response to any change in said sensor output signal.

13. The apparatus of claim 12, further comprising a carrier (5) and at least a catch selvage guide member (2, 2A) rotatably mounted on said carrier, and wherein said sensor means comprise at least one sensor marker on said guide member and at least one stationary sensor for each guide member positioned to be influenced by said sensor marker when said guide member rotates to produce said sensor output signal.

14. The apparatus according to claim 13, wherein said sensor marker carried by said rotatable guide member is a magnetic marker and wherein said sensor is a magnetic or Hall sensor.

15. The apparatus of claim 13, wherein said sensor marker carried by said rotatable guide member is an optical sensor marker, and wherein said sensor is an optical reflection sensor.

16. The apparatus of claim 13, wherein said rotatable guide member is a guide roller rotatably mounted on said carrier (5), and wherein said sensor means comprise a plurality of sensor markers secured to said guide roller at angularly spaced positions on or in said guide roller, and wherein said at least one stationary sensor is positioned for sequential cooperation with each of said plurality of sensor markers when said guide member rotates.

17. The apparatus of claim 16, wherein said guide roller is in frictional contact with said cut-off catch selvage for rotating said guide roller.

18. The apparatus of claim 13, wherein said sensor means comprise a dielectric capacitive marker secured to said rotatable catch selvage guide member, and wherein said sensor is a capacitive sensor.

19. The apparatus of claim 13, wherein said sensor means comprise one sensor marker secured to said rotatable catch selvage guide member, and a plurality of stationary angularly spaced sensors positioned for sequential cooperation with said one sensor marker when said guide member rotates.

20. The apparatus of claim 12, further comprising a carrier, a catch selvage guide member rigidly secured to said carrier in a stationary position, and wherein said sensor means comprise a piezoelectric sensor rigidly secured to said cut-off catch selvage guide member in a position for contact with the cut-off catch selvage moving on said guide member.

21. The apparatus of claim 12, wherein said sensor means comprise an r.p.m. sensor (30) operatively arranged for sensing an r.p.m. of said drive mechanism (25) to provide said sensor output signal as an r.p.m. representing signal, said apparatus further comprising means (8) for transmitting said r.p.m. representing signal to said signal processing unit (24) for producing said fault signal when said r.p.m. representing signal differs from a predetermined r.p.m. value.

* * * * *